US006903632B2

(12) United States Patent
Hashimoto et al.

(10) Patent No.: US 6,903,632 B2
(45) Date of Patent: Jun. 7, 2005

(54) BAND PASS FILTER

(75) Inventors: Tatsunori Hashimoto, Yokohama (JP); Fumihiko Aiga, Yokohama (JP); Hiroyuki Fuke, Kawasaki (JP); Yoshiaki Terashima, Yokosuka (JP); Mutsuki Yamazaki, Yokohama (JP); Hiroyuki Kayano, Fujisawa (JP)

(73) Assignee: Kabushiki Kaisha Toshiba, Tokyo (JP)

( * ) Notice: Subject to any disclaimer, the term of this patent is extended or adjusted under 35 U.S.C. 154(b) by 0 days.

(21) Appl. No.: 10/668,276

(22) Filed: Sep. 24, 2003

(65) Prior Publication Data

US 2004/0233013 A1 Nov. 25, 2004

(30) Foreign Application Priority Data

May 20, 2003 (JP) ..... 2003-142239

(51) Int. Cl.[7] ..... H01P 1/203; H01B 12/02
(52) U.S. Cl. ..... 333/204; 333/99 S; 505/210
(58) Field of Search ..... 333/202, 204, 333/205, 219, 99 S; 505/210

(56) References Cited

U.S. PATENT DOCUMENTS 5,648,747 A * 7/1997 Grothe et al. ..... 333/204
6,130,189 A * 10/2000 Matthaei ..... 333/99 S

OTHER PUBLICATIONS

Hey–Shipton, G., "Efficient Computer Design of Compact Planar Band–Pass Filters Using electrically Short Multiple Coupled Lines", IEEE MTT–S Digest, pp. 1547–1550, (1999).
Raihn, K. et al., "Highly Selective HTS Band Pass Filter with Multiple Resonator Cross–Couplings", IEEE MTT–S Digest, pp. 661–664, (2000).
Tsuzuki, G. et al., "Ultra Selective 22–Pole, 10–Transmission Zero Superconducting Bandpass Filter Surpasses 50 Pole Chebyshev Rejection", IEEE MTT–S CDROM, pp. 1963–1966, (2002).
Tsuzuki, G. et al., "Ultra Selective 22–Pole, 10–Transmission Zero Superconducting Bandpass Filter Surpasses 50 Pole Chebyshev Filter", IEEE Transactions on Microwave Theory and Techniques, vol. 50, No. 12, pp. 2924–2929, Dec. 2002.
Hong, J. et al., "Transmission Line Filters with Advanced Filtering Characteristics", IEEE MTT–S Digest, pp. 319–322, (2000).
Hong, J. et al., "Couplings of Microstrip Square Open–Loop Resonators for Cross–Coupled Planar Microwave Filters", IEEE Transactions on Microwave Theory and Techniques, vol. 44, No. 12, pp. 2099–2109, Dec. 1996.
Hong, J. et al., "On the Development of Superconducting Microstrip Filters for Mobile Communications Applications", IEEE Transactions on Microwave Theory and Techniques, vol. 47, No. 9, pp. 1656–1663, Sep. 1999.
Hong, J. et al., "On the Performance of HTS Microstrip Quasi–Elliptic Function Filters for Mobile Communications Application", IEEE Transactions on Microwave Theory and Techniques, vol. 48, No. 7, pp. 1240–1246, Jul. 2000.
Tsuzuki, G. et al., "Novel Superconducting Ring Filter", IEEE MTT–S Digest, pp. 379–382.

* cited by examiner

*Primary Examiner*—Seungsook Ham
(74) *Attorney, Agent, or Firm*—Finnegan, Henderson, Farabow, Garrett & Dunner, L.L.P.

(57) ABSTRACT

A band pass filter configured by a planar structure circuit, includes resonators of distribution constant circuit type, transmission line paths coupling the resonators and excitation lines arranged at input/output sides. The transmission line path is provided with line path portions coupling the resonators or the resonator and the excitation line. The line path portion have a length which is (1+2m)/4-fold (m: natural number) of a wavelength corresponding to a center frequency of the frequency band, and each coupling part between the resonators and the line portion has a length substantially determined as a ¼ wavelength.

17 Claims, 5 Drawing Sheets

BAND PASS FILTER

CROSS-REFERENCE TO RELATED APPLICATIONS

This application is based upon and claims the benefit of priority from the prior Japanese Patent Application No. 2003-142239, filed May 20, 2003, the entire contents of which are incorporated herein by reference.

BACKGROUND OF THE INVENTION

1. Field of the Invention

The present invention relates to a band pass filter, and more particularly to a band pass filter for use in communication devices.

2. Description of the Related Art

A band pass filter is a component which is needed to prevent interference of signals and effectively utilize a frequency. In the field of communications, performance of a filter is particularly important, as it determines an effective use of a frequency which is an important resource. That is, in regard to an electromagnetic wave transmitted/received by an antenna, an out-of-band signal is cut by a reception filter or a transmission filter, thereby greatly reducing interferences with an adjacent signal. In order to most effectively cut the out-of-band signal, a filter which can clearly separate each signal is desirable. However, in a high frequency band in particular, a super sharp cut filter is desirable in order to cut an adjacent signal in a very narrow band, but realization of such a very narrow band super sharp cut filter is very difficult.

Usually, a band pass filter on an RF stage is constituted by using many resonators. In the band pass filter constituted by many resonators, types of filter characteristics to be realized are determined by a value given to each coupling between the resonators. Further, whether the resonators are correctly coupled with each other determines whether the designed characteristic can be realized. In particular, in a narrow band filter that coupling between the resonators is very weak, coupling between the resonators is important.

There has been conventionally known a filter using a planar structure circuit as typified by a microstrip line, a strip line and others. For example, IEEE Microwave Theory and Techniques Symposium Digest (1998), p. 379 discloses a Chebychev filter that the number of path which couples the resonators is determined as one. In such a filter, realization of a narrow band is achieved by spatially increasing a distance between the resonators. Furthermore, IEEE Transactions on Microwave Theory and Techniques, Vol. 44 (1996), p. 2099 discloses a pseudo-elliptic function type which can suppress an insertion loss and constitute a sharp cut filter. This type of filter can be realized by introducing non-adjacent coupling to a filter such as a Chebychev filter having one path of signals and bringing in a shortcut path. Moreover, there has been developed a filter which adopts not only simple spatial coupling as strong non-adjacent coupling between resonators but carries out coupling through a transmission line path coupled with a resonator by using a short-length section such as disclosed in IEEE Microwave Theory and Techniques Symposium Digest (2000), p. 661, and a sharp cut type high-quality filter with a relatively broad band is realized. However, achieving both the very narrow band and the super sharp cut is difficult.

As described above, realization of a very narrow band super sharp cut filter is very difficult, by using a conventional filter. The reason will be described hereinafter as problems in the prior art.

There are two problems when realizing the super sharp cut filter. For example, in a Chebychev filter or the like which adopts a structure that coupling between resonators based on a gap is used and the number of path of couplings is one, such as disclosed in IEEE Microwave Theory and Techniques Symposium Digest (1998) p. 379, all the couplings become weak when each distance between the resonators is increased, but coupling of the resonators other than adjacent resonators does not become sufficiently weak. Therefore, the characteristic is disadvantageously disrupted when the coupling is adjusted by using the distance between the resonators to obtain a very narrow bandwidth filter. Additionally, since the distance between the resonators must be largely increased, the filter itself becomes large in size, a problem of a limitation in size of a substrate and the like restricts the design. Also, the sufficient number of resonators cannot be assured, and hence the sharp cut cannot be realized.

Another important problem becomes apparent when configuring the very narrow band sharp cut filter with a low insertion loss. In the regular Chebychev type filter, the number of resonators is increased in order to realize the sharp cut, but this is very disadvantageous in terms of the loss in case of the narrow band, and the insertion loss is greatly increased.

In order to reduce the insertion loss, it is necessary to constitute such a pseudo-elliptic function type which can suppress the insertion loss and configure the sharp cut filter as disclosed in IEEE Transactions on Microwave Theory and Techniques, Vol. 44(1996), p. 2099. This type of filter can be realized by introducing non-adjacent coupling to a filter, such as a Chebychev filter, having one path of signals and bringing in a shortcut path. Therefore, when a narrow band filter is tried to be realized, since weak non-adjacent coupling is introduced to the resonators which are originally connected by weak coupling, parasitic coupling is also generated to resonators other that those which should be coupled. This considerably disrupts the characteristic, and there occurs a problem that the sharp cut pseudo-elliptic function type filter cannot be successfully realized in the narrow band.

On the other hand, there has been developed such a filter which performs not only spatial coupling as strong non-adjacent coupling between the resonators, but also coupling through a transmission line path connected with the resonators via short-length sections, as disclosed in IEEE Microwave Theory and Techniques Symposium Digest (2000), p. 661. With this filter, a relatively-broad band sharp-cut high-quality filter can be realized. In this filter, however, spatial coupling between the resonators is also used for coupling between the adjacent resonators, but all the designed weak couplings are hard to be taken, thereby making it difficult to realize the very narrow band filter successfully. Additionally, in regard to non-adjacent coupling based on this transmission line path, there is a serious problem. This is a problem that an original resonance frequency of the resonators deviates by adding a transmission line path for coupling. In the very narrow band filter, since the band is originally very narrow, the filter is very sensitive to spatial distribution or the like of material parameters, adding such a deviation of the resonance frequency to this property results in a serious problem. For example, in the case of coupling the resonators, when a center frequency of each resonator is out of this band, which is assumed to be very narrow, realization of the band pass filter becomes very difficult.

As described above, the very narrow band sharp cut filter using a planar structure circuit is hard to realize based on only the prior art.

BRIEF SUMMARY OF THE INVENTION

It is an object of the present invention to provide a narrow band sharp cut band pass filter by stabilizing weak coupling between resonators.

According to an aspect of the invention, there is provided a band pass filter for passing a frequency band having a central wavelength which is corresponding to a center frequency, comprising:

a substrate;

input/output portions formed on the substrate;

a plurality of resonators provided between the input/output portions; and transmission line paths, each having coupling portions at both ends, the coupling portion being faced to one of the resonators with a gap, each of the transmission line paths having a length which is (1+2m)/4-fold (m: natural number) of the central wavelength, and each of the coupling portion having a length of a ¼ of the central wavelength.

Here, in this specification, it is determined that a wavelength means a wavelength in a transmission line formed by using a dielectric substrate, and a central wavelength means a wavelength corresponding to a center frequency.

DETAILED DESCRIPTION OF THE INVENTION

A band pass filter according to an embodiment of the present invention will now be described hereinafter with reference to the accompanying drawings.

In the following embodiments, description will be given based on a band pass filter having a function to pass through a signal in a narrow band or a very narrow band. Here, the narrow band and the very narrow band can be represented by a specific band $\Delta/f\mathbf{0}$ which is a ratio of a center frequency f0 of a signal to be passed with respect to a band width $\Delta$ corresponding to a wavelength of the signal to be passed and, in this specification, it is determined that the narrow band is not more than 2% in the specific band and the very narrow band is not more than 0.5% in the specific band.

Figure 1:
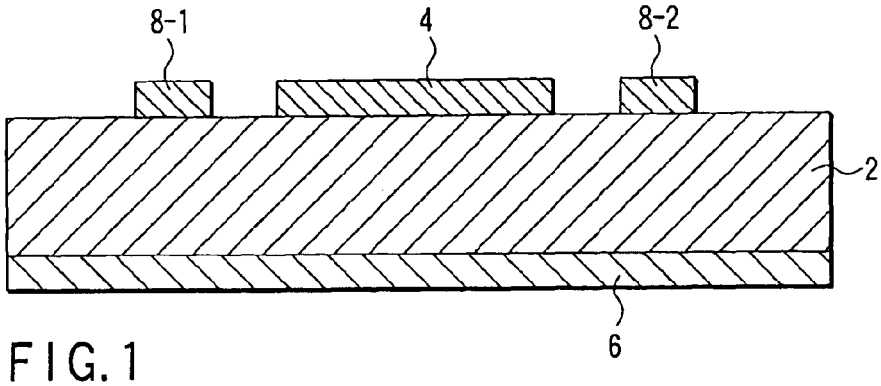
FIG. 1 is a cross-sectional view schematically showing a structure of a band pass filter according to an embodiment of the present invention.

FIG. 1 is a cross-sectional view schematically showing a basic structure of a superconducting filter according to an embodiment of the present invention.

A distribution constant circuit type resonator shown in FIG. 1 is a superconducting microstrip line path resonator, and there is formed a planar structure circuit by providing a pattern 4 of that resonator metal layer on an upper surface of a substrate 2 and excitation lines 8-1 and 8-2 on both sides of the pattern 4, and a thin film, e.g., a Y-based copper oxide superconducting film 6 is formed on a lower surface of this substrate 2. This substrate 2 has, e.g., a diameter of approximately 50 mm and a thickness of 0.43 mm, and it is formed of MgO having a relative dielectric constant of, e.g., 10. Further, as the superconducting film 6 of this microstrip line, for example, a Y-based copper oxide high-temperature superconducting thin film having a thickness of approximately 500 nm is used, and a line width of a strip conductor is approximately 0.4 mm. This superconducting thin film 6 can be formed by a laser deposition method, a sputtering method, a codeposition method and the like. The pattern 4 of the resonator is arranged in an area between the excitation lines 8-1 and 8-2. The pattern 4 of the resonator, the excitation lines 8-1 and 8-2 and the like are likewise formed of thin films, e.g., YBCO thin films of Y-based copper oxide superconducting films. A lower surface thin film 6 of the substrate is grounded.

Here, although description will be given taking the resonator that the microstrip line is formed into a predetermined shape as an example, it is apparent that a resonator in which a strip line is formed into a predetermined shape can be likewise applied. Furthermore, although there is known, e.g., a strip line such that the pattern 4 of the resonator is formed between a pair of substrates, a pattern structure of the resonator can be also adopted for the strip line, as will be described below.

Figure 2:
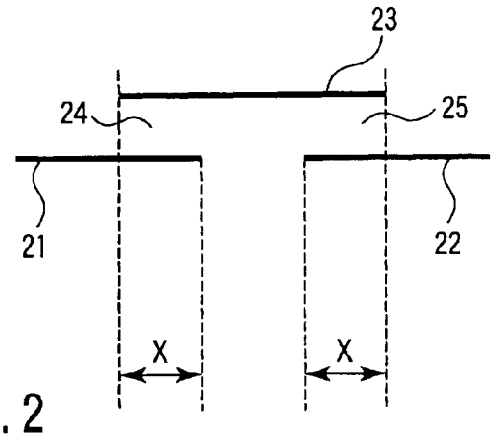
FIG. 2 is a plane view showing a first resonator pattern for illustrating a basic structure of the band pass filter according to the embodiment of the present invention.

FIG. 2 is a plane view showing a first resonator pattern for illustrating the basic structure of a filter according to an embodiment of the present invention. The resonators 21 and 22 constituting the first resonator pattern 4, which is shown in FIG. 1, are half-wavelength resonators, and their resonance frequency is determined as 5 GHz. That is, if the resonator 21 or 22 solely exists, when a signal frequency is gradually increased from 0 Hz to 5 GHz, the resonator 21 or 22 is firstly exited to generate a resonance at a resonance frequency of 5 GHz. A wavelength corresponding to this resonance frequency is twofold of a length of the resonator. Further, the resonators 21 and 22 are coupled through a transmission line path 23 having a length of a ¾ wavelength. The resonators 21 and 22 are opposed to the transmission line path 23 formed on the substrate 2 through gaps 24 and 25 by each predetermined length x, and extended in the same direction along the transmission 23 on the substrate 2. Therefore, the transmission line path 23 and the resonator 21, or the transmission line path 23 and the resonator 22 are respectively coupled through the gap 24 or 25. As a result, the resonators 21 and 22 are coupled through the gaps 24 and 25 and the transmission line path 23.

Figure 3:
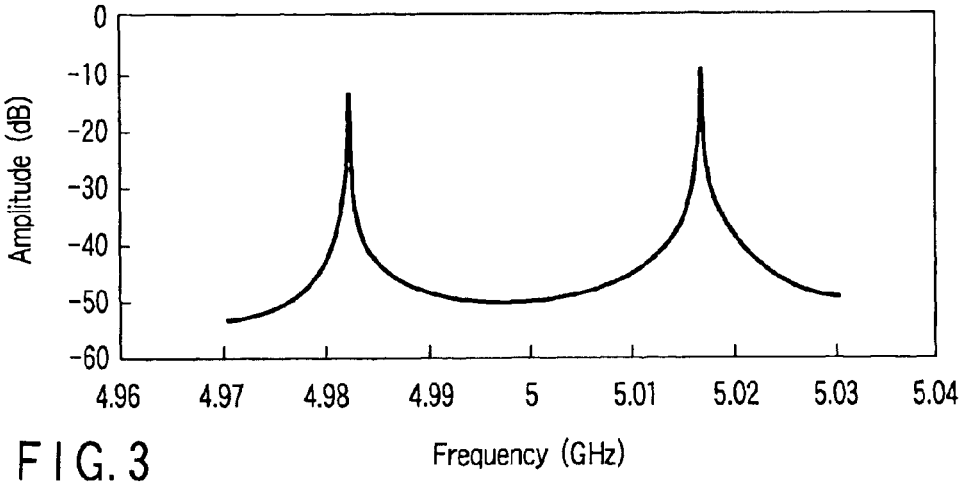
FIG. 3 is a graph showing a resonance characteristic of a filter having the resonator pattern depicted in FIG. 2.

In such a resonator pattern, each predetermined length x at the coupling parts between the resonators 21 and 22 and the coupling transmission line path 23 coupled via the gaps 24 and 25 is important, and this predetermined length x is substantially set to a ¼ wavelength. FIG. 3 shows a resonance characteristic of a filter having the resonator pattern 4 constituted by the resonators 21 and 22 and the transmission line path 23 illustrated in FIG. 2. In the resonance characteristic of the filter depicted in FIG. 3, there are two resonance points in the vicinity of the center frequency, and an average value of their frequencies matches with 5.00 GHz, which corresponds to the resonance frequency when the resonator is solely used. It can be understood that the resonance frequency of each resonator is not deviated by this coupling. As a value of coupling of the resonators, $10^{-4}$ or a lower value can be realized. Therefore, in the filter having the resonator pattern shown in FIG. 2, the frequency characteristic of the narrow band can be realized.

Figure 4:
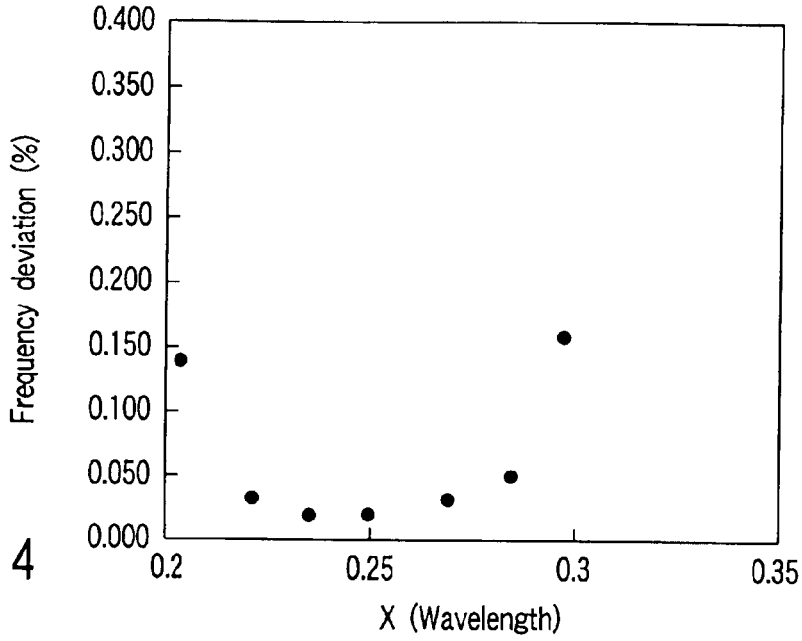
FIG. 4 shows a relationship between a length of a coupling part and a frequency deviation in a filter having the resonator pattern shown in FIG. 2.

FIG. 4 shows a relationship between the predetermined length x at the coupling part of the resonators 21 and 22 and frequency deviation. As apparent from FIG. 4, it can be understood that when the predetermined length x of the coupling part substantially corresponding to the ¼ wavelength falls within a range of 0.22 to 0.28 wavelengths, or more strictly a range of 0.24 to 0.27 wavelengths, a deviation of the resonance frequency becomes minimum in that range. That is because the resonator part is changed from the opened state to the short-circuited state or from the short-circuited state to the opened state with the ¼ wavelength, and positions of a node and an anti-node are substantially the same as those when the resonator is solely used, even if the coupling line path is coupled, since coupling through the gaps 24 and 25 is weak. Furthermore, when the predetermined length x of the coupling part is substantially set to the ¼ wavelength, a deviation of the frequency can be suppressed from being generated.

Figure 5:
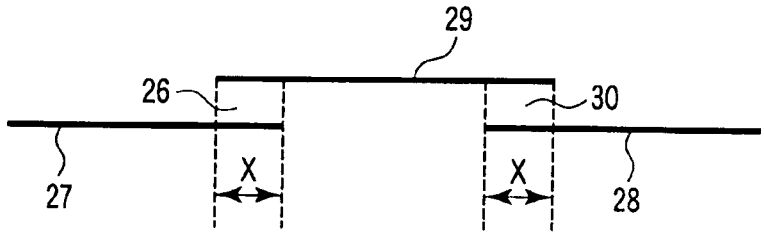
FIG. 5 is a plane view showing a second resonator pattern for illustrating a basic structure of a band pass filter according to another embodiment of the present invention.

FIG. 5 is a plane view showing a second resonator pattern for illustrating a basic structure of a filter according to another embodiment of the present invention.

In a filter structure shown in FIG. 1, a superconducting microstrip line path is formed on an MgO substrate having a thickness of approximately 0.43 mm and a relative dielectric constant of approximately 10. Here, a Y-based copper oxide high-temperature superconducting thin film having a thickness of approximately 500 nm is used as a superconductor of the microstrip line, and a line width of a strip conductor is formed to approximately 0.4 mm. The superconducting thin film is formed by a laser evaporation method, a sputtering method, a codeposition method or the like.

As shown in FIG. 5, resonators 27 and 28 constituting the second resonator pattern 4 are. one-wavelength resonators, and their resonance frequency is determined as 5 GHz. Each of the resonators 27 and 28 is opposed to a transmission line 29 formed on a substrate 2 by a predetermined length x through each of gaps 26 and 30, and extended in the same direction along the transmission 29 on the substrate 2. Therefore, the transmission line path 29 and the resonator 27, or the transmission line path 29 and the resonator 28 are respectively coupled through the gap 26 or 30. As a result, the resonators 27 and 28 are coupled through the transmission line path 29 having a length of a ⅝ wavelength.

Figure 6:
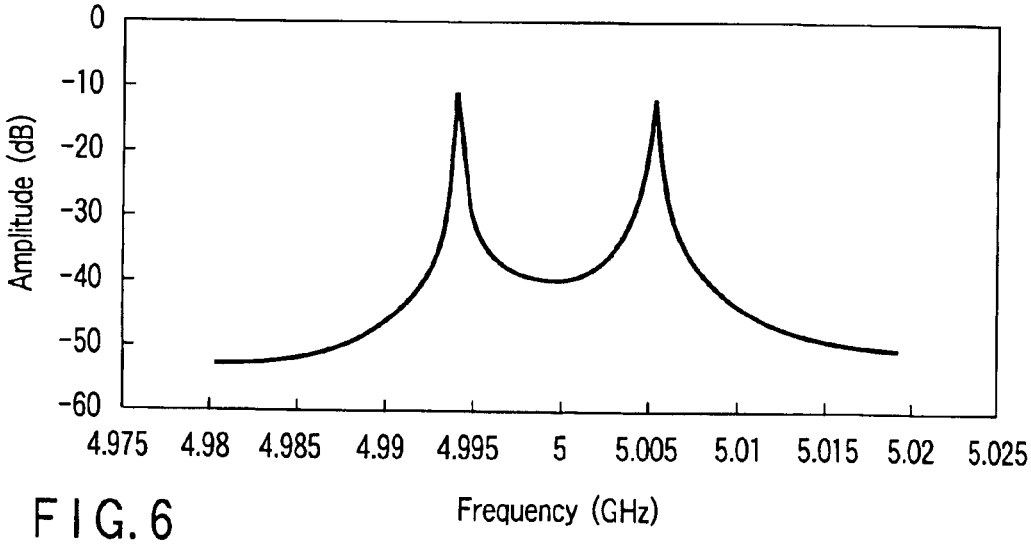
FIG. 6 is a graph showing a resonance characteristic of a filter having the resonator pattern depicted in FIG. 5.

In such a resonator pattern, the predetermined length x of each of coupling parts 26 and 30 between the resonators 27 and 28 and the coupling transmission line path 29 which are coupled through the gaps 26 and 30 is set to a ¼ wavelength. FIG. 6 shows a resonance characteristic of a filter having the resonator pattern 4 constituted by the resonators 27 and 28 and the transmission line path 29 illustrated in FIG. 5. In the resonance characteristic of the filter depicted in FIG. 5, there are two resonance points in the vicinity of the center frequency, and an average value of their frequencies matches 5.0 GHz, which corresponds to the resonance frequency when the resonator is solely used. It can be understood that the resonance frequency of each resonator is not deviated by this coupling. In the filter having the resonator pattern shown in FIG. 5, therefore, it is possible to realize the frequency characteristic of the narrow band.

Figure 7:
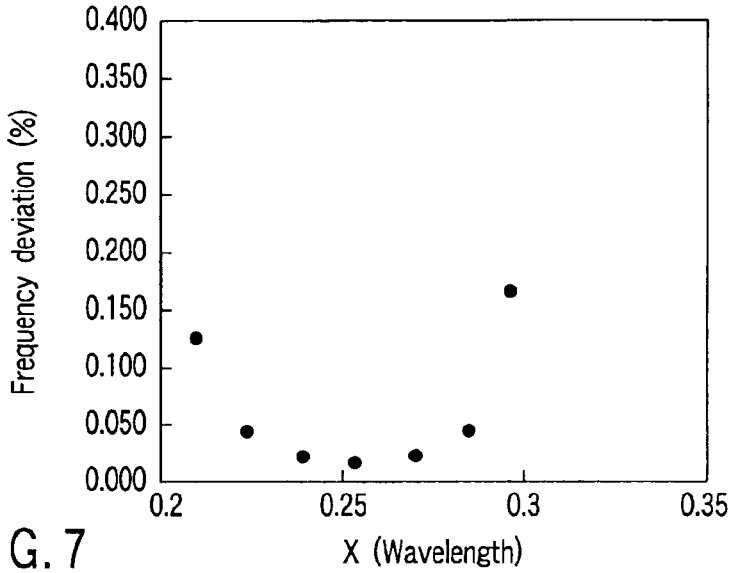
FIG. 7 shows a relationship between a length of a coupling part and a frequency deviation in the filter having the resonator pattern depicted in FIG. 5.

FIG. 7 shows a relationship between the length x of the coupling part of the resonator and a frequency deviation. As apparent from FIG. 7, it can be understood that when the predetermined length x of the coupling part substantially corresponding to the ¼ wavelength falls within a range of 0.22 to 0.28 wavelengths, or more strictly a range of 0.24 to 0.27 wavelengths, the frequency deviation becomes minimum in that range. That is because the resonator part is changed from the opened state to the short-circuited state or from the short-circuited state to the opened state with the ¼ wavelength and positions of a node and an anti-node are substantially the same as those when the resonator is solely used.

Figure 8:
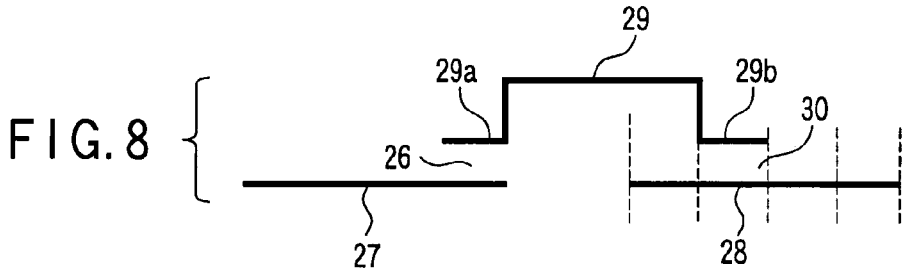
FIG. 8 is a plane view showing a third resonator pattern for illustrating a basic structure of a band pass filter according to another embodiment of the present invention.

Incidentally, in regard to this coupling position, as shown in FIG. 8, coupling can be performed at positions obtained by substantially partitioning off the resonators 27 and 28 in units of the ¼ wavelength like the example shown in FIG. 5. That is, a part of the transmission line path 29 other than coupling parts 29*a* and 29*b* is bent into a U-shape so as to be away from the resonators 27 and 28, and there is formed a transmission line path 29 having a shape that the coupling parts are added to the U-shaped portion. Each of the coupling parts 29*a* and 29*b* has a predetermined length x of the substantial ¼ wavelength, and a section of each of the resonators 27 and 28 is partitioned off by the predetermined length x of the substantial ¼ wavelength. Each of the coupling portions 29*a* and 29*b* with the predetermined length x in the partitioned section is opposed to a corresponding resonator in closest proximity thereto. In such a case, the coupling part 29*a* or 29*b* may be opposed at any position of the resonator 27 or 28. When the transmission line path 29 is bent in this manner, a deviation of coupling can be reduced as compared with a case that the transmission path 29 is linearly formed.

Figure 9:
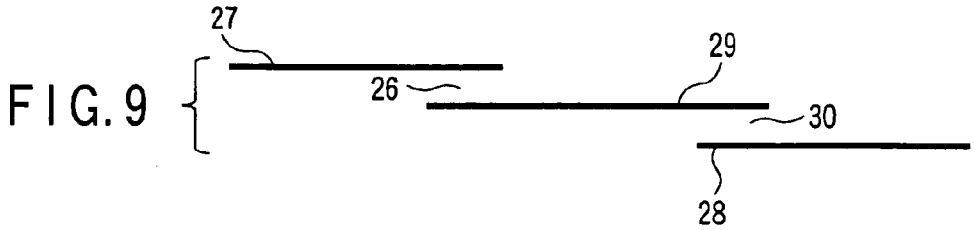
FIG. 9 is a plane view showing a fourth resonator pattern for illustrating a basic structure of a band pass filter according to a further embodiment of the present invention.

Moreover, coupling can be performed on a side opposite to the resonator as shown in FIG. 9. That is, one resonator 27 may be arranged on one side of an area partitioned off by the transmission line path 29, and the other resonator 28 may be arranged on the opposite side.

Additionally, the resonators 27 and 28 are not restricted to the one-wavelength resonators. Even if (n+2)/2 (n: natural number) wavelength resonators longer than one wavelength are used, coupling of the resonators 27 and 28 can be likewise established by using the transmission line 29.

Further, in the filter according to the embodiment of the present invention, resonators longer than a half wavelength and a coupling transmission line path longer than a half wavelength are used. In the filter having such a structure, these members resonate in frequency region lower than a pass band in theory and a cutoff characteristic is deteriorated in some cases. However, this deterioration in characteristic can be avoided by setting a band pass filter for a broad band, a low pass filter, a wide pass filter or the like on front and rear stages.

Various embodiments of the filter according to the present invention will now be described hereinafter with reference to FIGS. 10 to 17.

Embodiment 1

Figure 10:
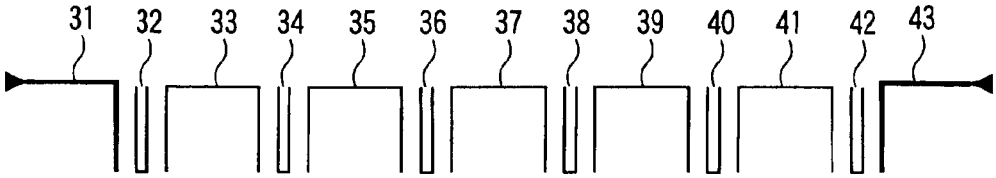
FIG. 10 is a plane view showing a Chebychev type band pass filter according to an embodiment of the present invention.

FIG. 10 is a plane view for illustrating one pattern of a filter according to an embodiment 1 of the present invention.

Like the description based on FIG. 1, a superconducting microstrip line is formed on an MgO substrate 2 having a thickness of approximately 0.43 mm and a relative dielectric constant of approximately 10. Here, a Y-based copper oxide high-temperature superconducting thin film having a thickness of approximately 500 nm is used as a superconductor of the microstrip line, and a line width of a strip conductor is approximately 0.4 mm. The superconducting thin film 4 is manufactured by a laser evaporation method, a sputtering method, a codeposition method or the like.

The filter shown in FIG. 10 is a Chebychev type filter including six resonators 32, 34, 36, 38, 40 and 42 between input/output line paths 31 and 43 formed by excitation lines. The six half-wavelength hairpin type resonators 32, 34, 36, 38, 40 and 42 whose open sides are directed in the same direction are arranged in a line, and substantially-U-shaped coupling line paths 33, 35, 37, 39 and 41 each having a ¾ wavelength in order to couple resonators adjacent to each other, are arranged between the respective hairpin type resonators 32, 34, 36, 38, 40 and 42. As apparent from the arrangement shown in FIG. 10, this filter is constituted as a Chebychev type that non-adjacent couplings are not intentionally adopted, and weak couplings are realized by using all coupling transmission lines between the half-wavelength resonators adjacent to each other. Here, a resonance frequency of each resonator is set to 5 GHz which is a center frequency of the filter, and a band width is set to 10 MHz. Furthermore, a wavelength corresponding to this resonance frequency is twofold a length of each resonator. Moreover, a length x of a coupling part of each of all the coupling line path and all the resonators is selected as 0.23 of a wavelength which is substantially a ¼ wavelength.

Figure 11:
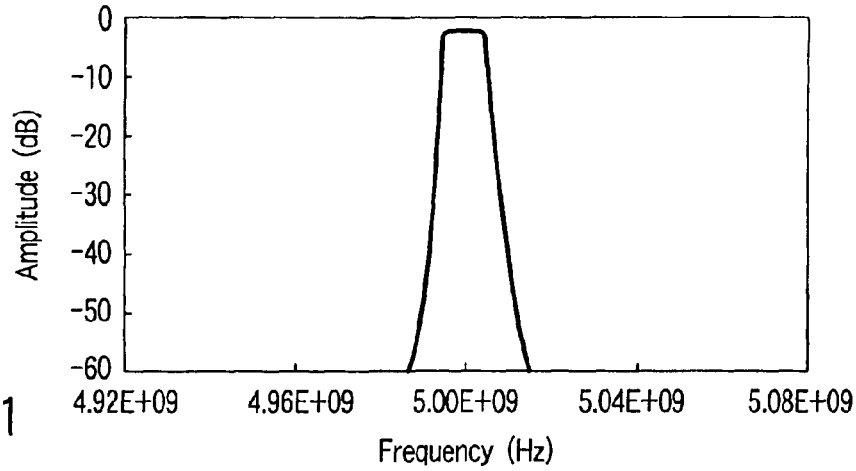
FIG. 11 is a graph showing a filter characteristic of the Chebychev type filter depicted in FIG. 10.

FIG. 11 shows a characteristic obtained by the filter having the arrangement depicted in FIG. 10. As apparent from FIG. 11, irrespective of a very small specific band which is 0.20%, since small coupling can be stably achieved, it is revealed that disruption in the band is very small and the excellent characteristic can be obtained. Therefore, according to the filter having such a structure as shown in FIG. 10, it is possible to realize the very narrow band filter.

Embodiment 2

Figure 12:
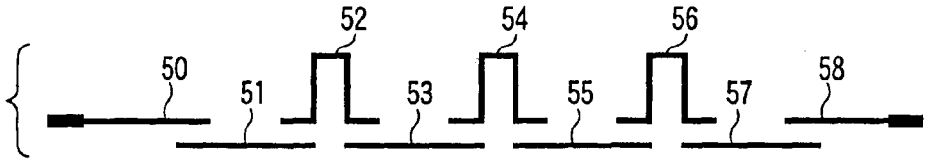
FIG. 12 is a plane view showing a Chebychev type band pass filter according to a further embodiment of the present invention.
Figure 13:
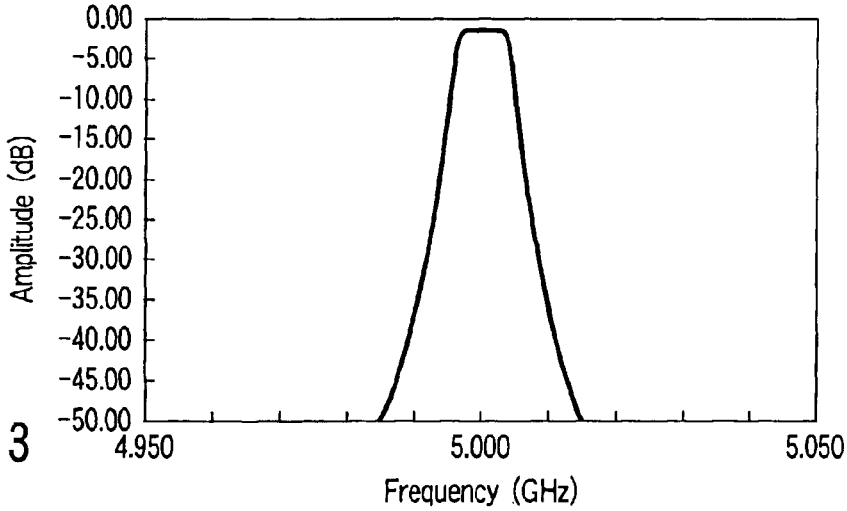
FIG. 13 is a graph showing a filter characteristic of the Chebychev type filter depicted in FIG. 12.

FIG. 12 is a plane view for illustrating one pattern of a filter according to another embodiment of the present invention. The filter shown in FIG. 12 is a Chebychev filter including four resonators 51, 53, 55 and 57 between input/output line paths 50 and 58 formed by excitation lines. As the resonators, there are used one-wavelength linear type resonators 51, 53, 55 and 57. Therefore, a wavelength corresponding to a resonance frequency matches a length of each resonator. Additionally, the resonators 51, 53, 55 and 57 adjacent to each other are coupled through line paths 52, 54 and 56 bent into such a shape as shown in FIG. 8, respectively. Each of the transmission line paths 52, 54 and 56 has a length of a 7/4 wavelength, a length x of each coupling portion is substantially determined as a ¼ wavelength, and this coupling portion is arranged in closest proximity to a corresponding resonator. As described above, since the length of each resonator is determined as one wavelength, edges of the two coupling line paths coupled to the resonators can be sufficiently separated from each other, and it is revealed that an excellent narrow band characteristic can be obtained as shown in FIG. 13 even if the linear resonators are used.

In the filters according to the embodiments depicted in FIGS. 10 and 12, although the linear type or hairpin type resonators are adopted as the resonators 32, 34, 36, 38, 40, 42, 51, 53, 55 and 57, the present invention is not restricted thereto, and resonators having various shapes such as an open loop type can be used.

It is to be noted that the circuit is configured by the microstrip line in the embodiment shown in FIG. 12, but the circuit can be also constituted by a strip line. Further, when realizing the narrower band filter, metal partitions can be provided between the coupling line paths, between the resonators or between the resonators and the coupling line paths.

Embodiment 3

Figure 14:
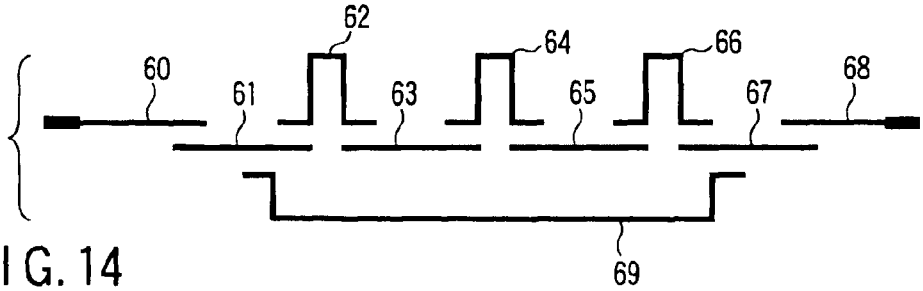
FIG. 14 is a plane view showing a pseudo-elliptic function type band pass filter according to a still further embodiment of the present invention.

FIG. 14 is a plane view for illustrating one pattern of a filter according to still another embodiment of the present invention.

In the filter shown in FIG. 14, a superconducting microstrip line path is formed on an MgO substrate (not shown) having a thickness of approximately 0.43 mm and a relative dielectric constant of 10. Here, a Y-based copper oxide high-temperature superconducting thin film having a thickness of approximately 500 nm is used as a superconductor of the microstrip line, and a line width of a strip conductor is approximately 0.4 mm. The superconducting thin film is manufactured by a laser evaporation method, a sputtering method, a codeposition method or the like.

The filter shown in FIG. 14 is a four-stage filter constituted by four linear resonators 61, 63, 65 and 67 provided between input/output line paths 60 and 68 formed by excitation lines. In the filter depicted in FIG. 14, a one-wavelength resonator is used as each resonator, and the adjacent resonators 61, 63, 65 and 67 are coupled by transmission lines 62, 64 and 66 each having a length of a 7/4 wavelength through coupling parts each having a length x which is substantially a ¼ wavelength. Moreover, the resonators 61 and 67 are non-adjacently-coupled by a transmission line path 69. Here, determining the resonators 61 and 67 as references, the coupled transmission line 62 and 66 are arranged in one area, and the transmission line path 69 having a 17/4 wavelength is arranged in the other area provided on the opposite side. In the other area, the coupling parts of the transmission line path 69 each substantially having a ¼ wavelength are opposed to the resonators 61 and 67. In design of this filter, a normalization low pass filter which sets a zero point of a transfer function to ±1.5j is used. Here, j is an imaginary number unit.

Figure 15:
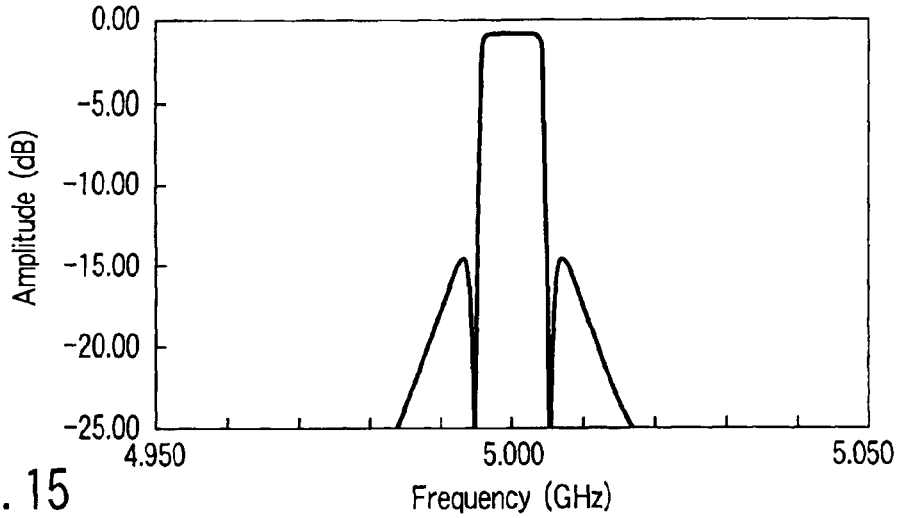
FIG. 15 is a graph showing a filter characteristic of the pseudo-elliptic function type filter illustrated in FIG. 14.

FIG. 15 shows a characteristic obtained in the filter having the arrangement depicted in FIG. 14 by measurement in the vicinity of the center frequency. As apparent from FIG. 14, according to the filter having the structure depicted in FIG. 14, it is revealed that the frequency characteristic of the notched sharp cut narrow band can be obtained.

In the filter shown in FIG. 14, although each resonator is of a linear type, various kinds of resonators such as an open loop type can be also used.

It is to be noted that the circuit is configured by the microstrip line in the filter shown in FIG. 14, but the circuit can be constituted by the strip line.

Embodiment 4

Figure 16:
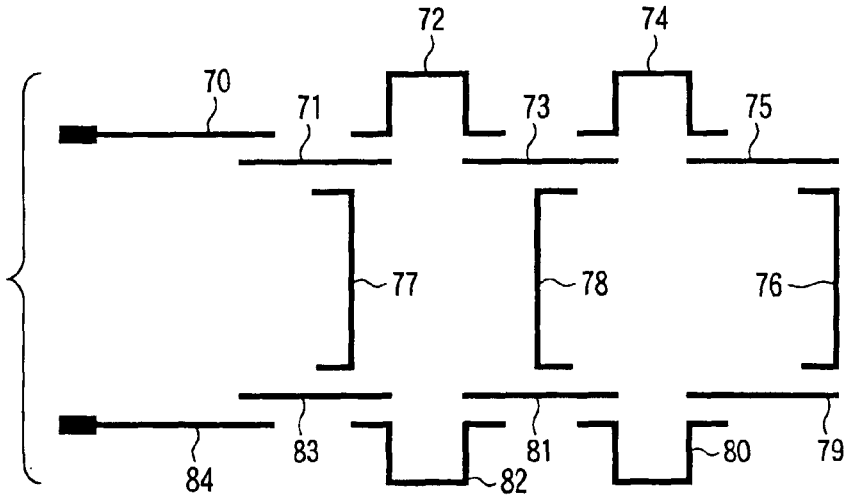
FIG. 16 is a plane view showing a pseudo-elliptic function type band pass filter according to a yet further embodiment of the present invention.

FIG. 16 is a plane view for illustrating one pattern of a filter according to yet another embodiment of the present invention. In the filter shown in FIG. 16, a superconducting microstrip line path is formed on an MgO substrate 2 having a thickness of approximately 0.43 mm and a relative dielectric constant of approximately 10. Here, a Y-based copper oxide high-temperature superconducting thin film having a thickness of approximately 500 nm is used as a superconductor of the microstrip line path, and a line is path width of a strip conductor is approximately 0.4 mm. The superconducting thin film is manufactured by a laser evaporation method, a sputtering method, a codeposition method or the like.

In the filter shown in FIG. 16, there is arranged a six-stage filter constituted by six linear resonators 71, 73, 75, 79, 81 and 83 between input/output line paths 70 and 84 formed by excitation lines. Here, one-wavelength resonators are used as the resonators 71, 73, 75, 79, 81 and 83, and transmission line paths 72, 74, 76, 80 and 82 each having a ⅞ wavelength are used for coupling of the adjacent resonators through coupling parts each substantially having a ¼ wavelength. Moreover, for non-adjacent coupling, there are used transmission line paths 77 and 78 each of which is arranged on the opposite side of the line paths 72, 74, 80 and 82 for coupling the adjacent resonators 71, 73, 75, 79, 81 and 83, pulled out through coupling portions each substantially having a length of a ¼ wavelength and has a ⅞ wavelength. In design, a normalized low pass filter which sets a zero point of a transfer function to ±1.25j and ±2j is used. Here, j is an imaginary number unit.

Figure 17:
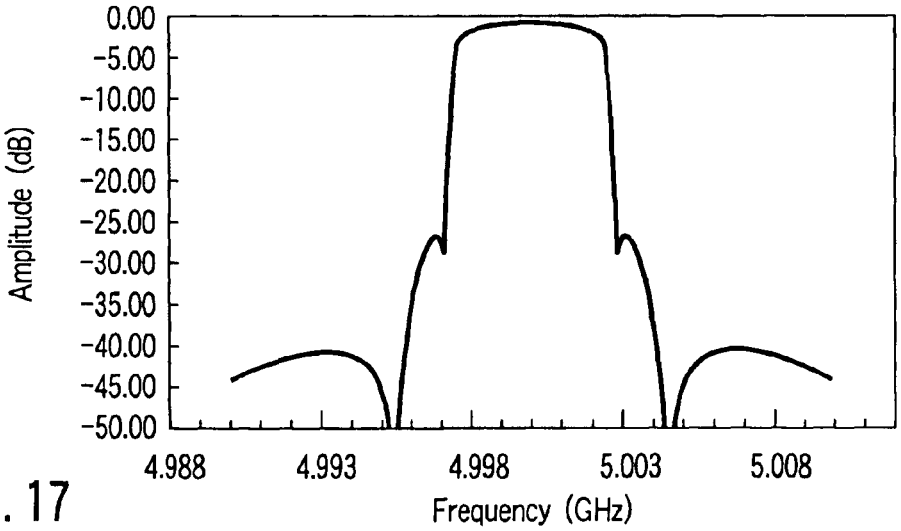
FIG. 17 is a graph showing a filter characteristic of the pseudo-elliptic function type filter illustrated in FIG. 16.

FIG. 17 shows a characteristic obtained by the filter having the arrangement depicted in FIG. 16. As apparent from FIG. 17, according to the filter having the structure illustrated in FIG. 16, it is revealed that the characteristic of the sharp cut narrow band with four notches can be obtained.

In the filter shown in FIG. 16, although each resonator is of a linear type, various kinds of resonators, such as an open loop type, can be likewise used.

It is to be noted that the circuit is configured by the microstrip line in this embodiment, but the circuit can be also constituted by the strip line. Further, the MgO substrate is used in this embodiment, but a sapphire substrate may also be used.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general invention concept as defined by the appended claims and their equivalents.

What is claimed is:

1. A band pass filter for passing a frequency band having a central wavelength which is corresponding to a center frequency, comprising:

a substrate;

input/output portions formed on the substrate;

a plurality of resonators provided between the input/output portions; and transmission line paths, each having coupling portions at both ends, the coupling portion being faced to one of the resonators with a gap, each of the transmission line paths having a length which is (1+2m)/4 (m: natural number) of the central wavelength, and each of the coupling portion having a length of a ¼ of the central wavelength.

2. The band pass filter according to claim 1, wherein the resonator has a length which is n/2 (n: natural number) of the central wavelength.

3. The band pass filter according to claim 1, wherein at least one of the resonators is formed by a superconductor.

4. The band pass filter according to claim 1, wherein the resonator includes linear portions which are continuously connected, each of the linear portions having a unit of a ¼ of the central wavelength, and the linear portions arranged at the both ends of the resonator corresponds to the coupling portions.

5. The band pass filter according to claim 1, wherein the transmission line paths include linear portions which are continuously connected.

6. The band pass filter according to claim 1, wherein one of the resonators is coupled with the three transmission line paths.

7. The band pass filter according to claim 1, wherein the substrate consists of MgO.

8. The band pass filter according to claim 1, wherein the resonators are linear.

9. The band pass filter according to claim 1, wherein the transmission line paths are linear.

10. The band pass filter according to claim 1, wherein the resonators and the transmission line paths are arranged alternately.

11. The band pass filter according to claim 3, wherein the superconductor is Y-based copper oxide high-temperature superconducting thin film.

12. The band pass filter according to claim 3, wherein the resonators consist of a microstrip line path.

13. The bank pass filter according to claim 3, wherein the transmission line paths consist of a microstrip line.

14. The band pass filter according to claim 4, wherein the two adjacent linear portions make a right angle.

15. The band pass filter according to claim 5, wherein the two adjacent linear portions make a right angle.

16. The band pass filter according to claim 1, wherein the resonators and the transmission line paths include both types of a linear and a bend.

17. The band pass filter according to claim 1, wherein different lengths of the transmission line paths are included.

* * * * *

UNITED STATES PATENT AND TRADEMARK OFFICE

CERTIFICATE OF CORRECTION

PATENT NO. : 6,903,632 B2
DATED : June 7, 2005
INVENTOR(S) : Hashimoto et al.

It is certified that error appears in the above-identified patent and that said Letters Patent is hereby corrected as shown below:

Title page,
Item [57], ABSTRACT,
Line 7, change “portion” to -- portions --.

Column 10,
Line 19, change “portion” to -- portions --.
Line 52, change “bank” to -- band --.

Signed and Sealed this

Ninth Day of August, 2005

JON W. DUDAS
*Director of the United States Patent and Trademark Office*